US005721391A

United States Patent [19]

Thorsted et al.

[11] Patent Number: 5,721,391

[45] Date of Patent: Feb. 24, 1998

[54] ELECTRONIC FIRING CIRCUIT

[75] Inventors: Gregory G. Thorsted; Douglas A. Hopkins, both of King George; Kenneth R. Nichols, Fredericksburg, all of Va.

[73] Assignee: The United States of America as represented by the Secretary of the Navy, Washington, D.C.

[21] Appl. No.: 703,233

[22] Filed: Aug. 26, 1996

[51] Int. Cl.[6] ..... F23Q 7/00

[52] U.S. Cl. ..... 102/218; 361/251

[58] Field of Search ..... 102/218, 206; 361/248, 251, 250

[56] References Cited

U.S. PATENT DOCUMENTS

| | | | |
|---|---|---|---|
| 2,546,952 | 3/1951 | Spencer . | |
| 2,933,690 | 4/1960 | Baum . | |
| 3,611,210 | 10/1971 | Theodore . | |
| 4,095,508 | 6/1978 | Lienau . | |
| 4,320,704 | 3/1982 | Gawlick et al. | 102/218 |
| 4,651,646 | 3/1987 | Foresman et al. | 102/218 |
| 4,700,263 | 10/1987 | Marshall et al. | 361/251 |
| 4,748,382 | 5/1988 | Walker . | |
| 4,803,378 | 2/1989 | Richardson . | |
| 5,031,537 | 7/1991 | Taylor | 102/218 |
| 5,473,986 | 12/1995 | Hau | 102/206 |
| 5,476,044 | 12/1995 | Boucher | 102/218 |
| 5,510,952 | 4/1996 | Bonavia et al. | 361/251 |

*Primary Examiner*—Michael J. Carone
*Assistant Examiner*—Christopher K. Montgomery
*Attorney, Agent, or Firm*—James B. Bechtel, Esq.

[57] ABSTRACT

A firing circuit that is used for a lightweight launcher for propelling rockets is disclosed. The firing circuit generates a pulse for firing the rocket launcher and comprises first and second capacitor banks. The first capacitor bank acts as low impedance energy source, in which power is developed to supply sufficient energy to initiate the rocket motor squib which, in turn, ignites the rocket motor of the rocket. The second capacitor bank acts as a high voltage, low impedance source whose energy is used to charge a capacitor internal to the rocket. The capacitor internal to the rocket, is part of the rocket warhead fuse. The capacitor internal to the fuse is used to initiate the detonator of the rocket warhead when the rocket terminates flight at target.

8 Claims, 7 Drawing Sheets

ELECTRONIC FIRING CIRCUIT

STATEMENT OF GOVERNMENT INTEREST

The invention described herein may be manufactured and used by or for the Government of the United States of America, for governmental purposes, without the payment of any royalty thereon or therefor.

BACKGROUND OF THE INVENTION

The present invention relates to a firing circuit and, more particularly, to a firing circuit used in a lightweight portable launcher that fires rockets. The firing circuit has means to ensure for proper operation thereof in spite of any drain of current on a battery powering the firing circuit.

In recent years there has been developed a lightweight launcher that propels rockets therefrom and that can be handled by one man. The rockets normally have a high explosive warhead and are extremely useful against tanks and vehicles. Since the lightweight launcher is used in combat it must be highly reliable, especially its firing circuit that generates an excitation signal to cause the rocket to be propelled therefrom.

The firing circuit commonly employs electromagnetic devices such as an electromagnetic generator, commonly referred to as a magneto, possessing one or more mechanically moving components. The electromagnetic generator, although rugged, suffers drawbacks because its mechanical parts or component may be subjected to the intrusion of dirt therein to render them inoperative or relatively high external magnetic fields coupled by the electromagnetic device may render non-magnetic components, such as diodes therein, inoperative. In addition to the drawbacks plagued by generators having mechanical components even electronic devices may malfunction due to an excessive current drain on a battery that produces the power needed to operate the portable launcher. This excessive current drain sometimes takes place when switch devices, both of the mechanical and non-mechanical (electronic) types, are instantaneously switched to advantageous delivery battery current to devices but disadvantageously drain the battery so that other electronic devices are left with inadequate excitation leading to their malfunction. If any failure occurs because of this inadequate excitation, dirt rendering a mechanical component inoperative, or a relatively high magnetic field rendering a non-mechanical component inoperative, the firing circuit has failed which, in turn, renders the lightweight launcher inoperative. It is desired that the launcher, in particular, the firing circuit, be devoid of mechanical components, susceptible to relatively high magnetic fields, and of any uncompensated excessive drain on the battery, thereby, improving the reliability of the firing circuit and, correspondingly, the reliability of the portable launcher itself.

SUMMARY OF THE INVENTION

The present invention is directed to a firing circuit that is devoid of the drawbacks that has plagued prior art firing circuits for portable launchers so as to improve the reliability of the firing circuit and more efficiently serve the needs of the launcher, especially when such is used in combat.

The firing circuit is powered by a battery, serving as the primary power source, and generates a sharp transient firing pulse. The firing circuit comprises at least one manual switch, a first bank of capacitors, a dc-dc converter, a second bank of capacitors, first and second sources of timing, and first, second, and third electronic switches. Then at least one manual switch is switchably connected to the battery and has means for generating first and second commands. The first bank of capacitors serves as a secondary power source and has first an input and an output with the input switchably connected to and chargeable by the battery by means of the first switch command. The dc-dc converter is connected to the second bank of capacitors and develops an output voltage having a value greater than that of the battery. The second bank of capacitors has an input and an output with the input connected to the output voltage of the dc-dc converter. The first source of timing is connected to the output of the first bank of capacitors and switchably connected to the battery and is responsive to the second command. The first source of timing generates first, and second timing signals. The second source of timing is also connected to the output of the first bank of capacitors and switchably connected to the battery and is responsive to the second command. The second source of timing generates a third timing signal. The first electronic switch has input, output and control electrodes with the input electrode connected to the output of the second capacitor bank. The control electrode is connected to the second timing signal and the output electrode is connected to a positive terminal of the firing circuit. The second electronic switch has input, output, and control electrodes with the input electrode connected to the battery and switchably connected to the output of the first bank of capacitors. The control electrode of the second electronic switch is connected to the first timing signal, and the output electrode is connected to the positive terminal of the firing circuit. The third electronic switch also has input, output and control electrodes with the input electrode connected to a negative terminal of the firing circuit. The control electrode of the third electronic switch is connected to the third timing signal and the output electrode is connected to the negative terminal of the battery. The input electrode of the third electronic switch is connected to the negative terminal of the firing circuit.

Accordingly, it is an object of the present invention to provide a firing circuit responsive to manual switches and that generates a sharp transient pulse and has a first capacitor bank serving as a secondary or supplemental power source.

It is a further object of the present invention to provide for a firing circuit that is devoid of mechanical components, especially those components rendered inoperative by dirt, so as to increase the reliability of the firing circuit.

Further still, it is an object of the present invention to provide a firing circuit that is devoid of electromagnetic generators that couple relatively high magnetic fields that might otherwise render electronic components of the firing circuit inoperative.

Still further, it is an object of the present invention to provide for an electronic firing circuit that successfully operates in spite of any instantaneous drain of current on the battery used as the primary source of electrical power of the launcher.

Other objects, advantages and novel features of the invention will become apparent from the following detailed description when considered in conjunction with the accompanying drawings therein.

DETAILED DESCRIPTION OF THE PREFERRED EMBODIMENTS

Figure 1:
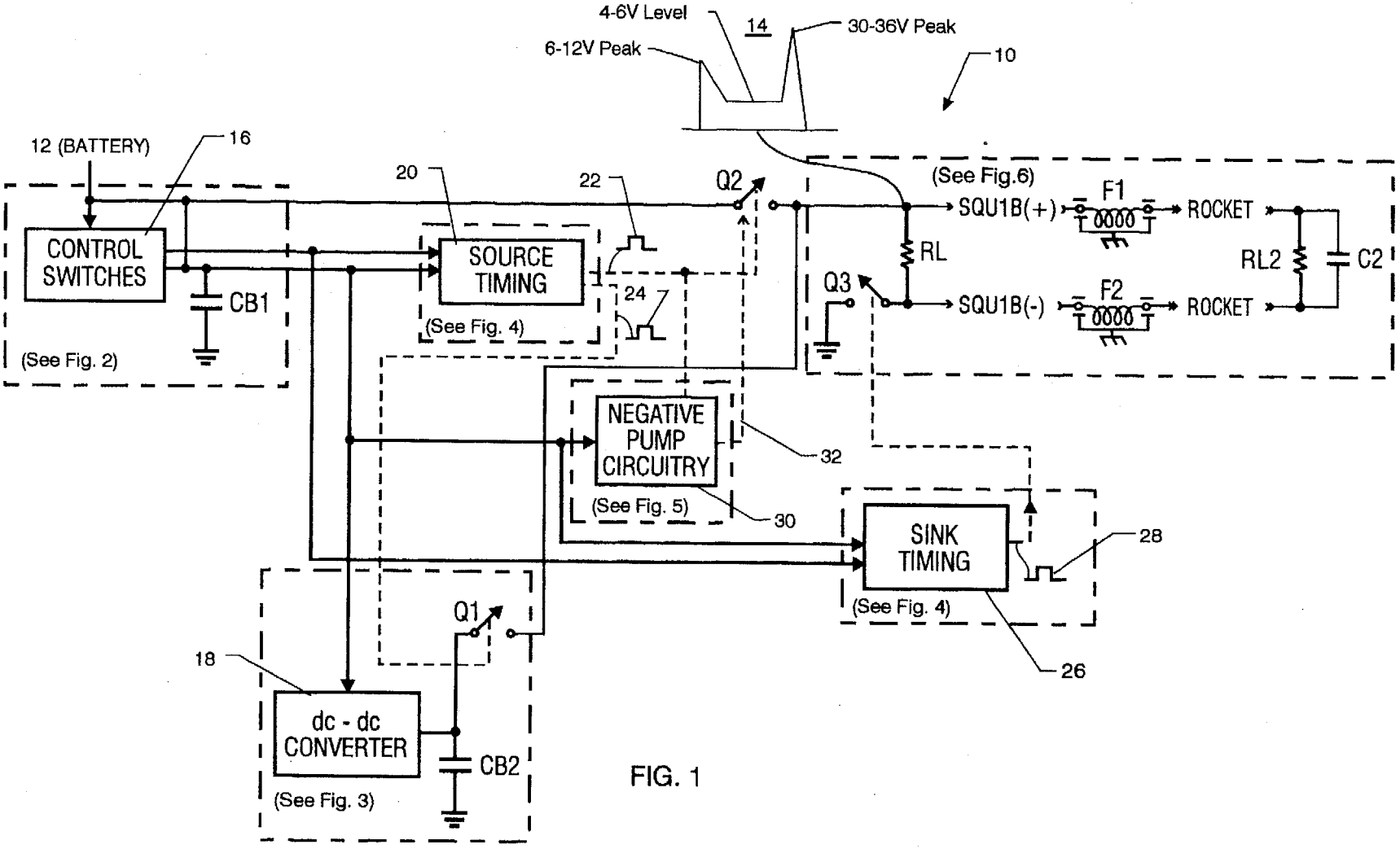
FIG. 1 is a block diagram illustrating the interrelationship of the primary elements of the present invention.

With reference to the drawings, wherein the same reference numbers indicate the same elements throughout, FIG. 1 illustrates a block diagram of the firing circuit 10 of the present invention. The firing circuit 10 is powered by battery 12 serving as a primary power source thereof and having a typical value from about 12V to about 15V with associated positive (+) and negative (–) terminals (not shown). The firing circuit 10 generates a firing pulse 14 having a sharp transient leading edge with a peak of about 30 to 36 volts, a lagging edge with peak of about 6 to 12 volts and with the peaks being joined by a relatively flat level portion of about 4 to 6 volts. The firing pulse 14 is applied across a load resistor RL which, in turn, is connected across the output terminals of the firing circuit 10 shown as being squib (+) and squib (–) which respectively carry the same potential as the (+) and (–) terminals of the battery 12. In addition to a capacitor CL (internal to the rocket) there is a resistor RL2 (the actual squib) which is connected in parallel with the capacitor CL.

The firing circuit 10 comprises control switches 16, a first bank of capacitors CB1, a dc-dc converter 18, a source of timing 20 generating first and second timing signals 22 and 24 that are respectively applied to transistors Q2 and Q1, a sink timing circuit 26 generating a third timing signal 28 that is applied to transistor Q3, and a negative pump circuitry 30 receiving the first timing signal 22 and generating a control signal 32 that is applied to transistor Q2. Transistors Q2 and Q1 are referred to herein as being source switching devices in that they control the application of the primary power source, as well as the stored energy in CB1 and CB2, that is, the battery 12 and capacitor banks CB1 and CB2 are responsive to the source timing 20, whereas transistor Q3 is referred to herein as being a sink switching device in that it controls the sinking of the current of the battery 12 as well as current supplied by capacitor banks CB1 and CB2 and the firing circuit and is responsive to the sink timing 26. The transistors Q1, Q2 and Q3, as well as other transistors to be described, are three terminal devices having input, control and output electrodes. Transistors Q1, Q2 and Q3 are in the output stage of the firing circuit 10 and are arranged across a load resistor RL which, in turn, is arranged across in-line filters F1 and F2 (known in the art) which, in turn, are connected in series with a fuse or load capacitor CL located in the rocket. Capacitor CL is also arranged in parallel with resistor RL2. The resistor RL2 (representative of the resistance of the rocket motor squib) is also located in the rocket.

In general, the firing circuit 10 generates the pulse 14 having a sharp rising leading edge and a very high voltage trailing edge for energizing a squib of the rocket motor and for charging the fuse capacitor (CL). The squib is a pyrotechnic device which ignites the propellant of the rocket motor. After the rocket is launched as a result of the squib firing, the target is hit and the capacitor CL in the rocket delivers voltage to fire the detonator of the warhead of the rocket.

The firing circuit 10 comprises first and second capacitor banks CB1 and CB2 respectively controlled by first and second switches of control switches 16. The first capacitor bank CB1 acts as a supplemental energy source. The capacitor bank CB1 supplies the energy for the sharp rising leading edge of firing pulse 14. The energy source provided by the first capacitor bank CB1 is arranged to cooperate with the primary power source, that is, the battery 12 so that, as to be further described, any switching that may occur in the firing circuit 10 does not cause an excessive current drain on the battery 12 that would otherwise leave electronic elements of the firing circuit 10 with insufficient excitation so as to allow them to malfunction. The firing circuit 10 comprises a plurality of elements arranged as illustrated in FIGS. 2–6 (all to be described) and whose typical value or type is given in Table 1.

TABLE 1

| ELEMENT | TYPICAL VALUE/COMPONENT |
|---|---|
| R1 | 10K Ω |
| R2 | 200K Ω |
| R3 | 10K Ω |
| R4 | 1 Ω |
| R5 | 100 Ω |
| R6 | 5.11 Ω |
| R7 | 10K Ω |
| R8 | 100K Ω |
| R9 | 10K Ω |
| R10 | 100K Ω |
| R11 | 10K Ω |
| R12 | 49.9K Ω |
| R13 | 100K Ω |
| R14 | 200K Ω |
| R15 | 100K Ω |
| R16 | 150K Ω |
| R17 | 10K Ω |
| RL2 | 1 Ω |
| R18 | 200K Ω |
| R19 | 200K Ω |
| R20 | 20K Ω |
| C1 | 180 microfarads |
| C2 | 180 microfarads |
| C3 | 180 microfarads |
| C4 | 180 microfarads |
| C5 | 39 microfarads |
| C6 | 39 microfarads |
| C7 | 39 microfarads |
| C8 | 39 microfarads |
| C9 | 0.39 microfarads |
| C10 | 0.39 microfarads |
| C11 | 0.47 microfarads |
| C12 | 0.39 microfarads |
| C13 | 1.0 microfarads |
| C14 | 22 microfarads |
| C15 | 0.01 microfarads |
| C16 | 0.01 microfarads |
| CR1 | 1N5807 |
| CR2 | 1N5807 |
| CR3 | 1N4148 |
| VR1 | 1N754 |
| VR2 | 1N4112 |
| VR3 | 1N4100 |
| Q1 | 2N6849 |
| Q2 | 2N6849 |
| Q3 | 2N6796 |
| Q4 | 2N6849 |
| Q5 | 2N6796 |
| Q6 | 2N2222A |
| Q7 | 2N2222A |
| Q8 | 2N2222A |
| Q9 | 2N2222A |
| Q10 | 2N4150 |

Figure 2:
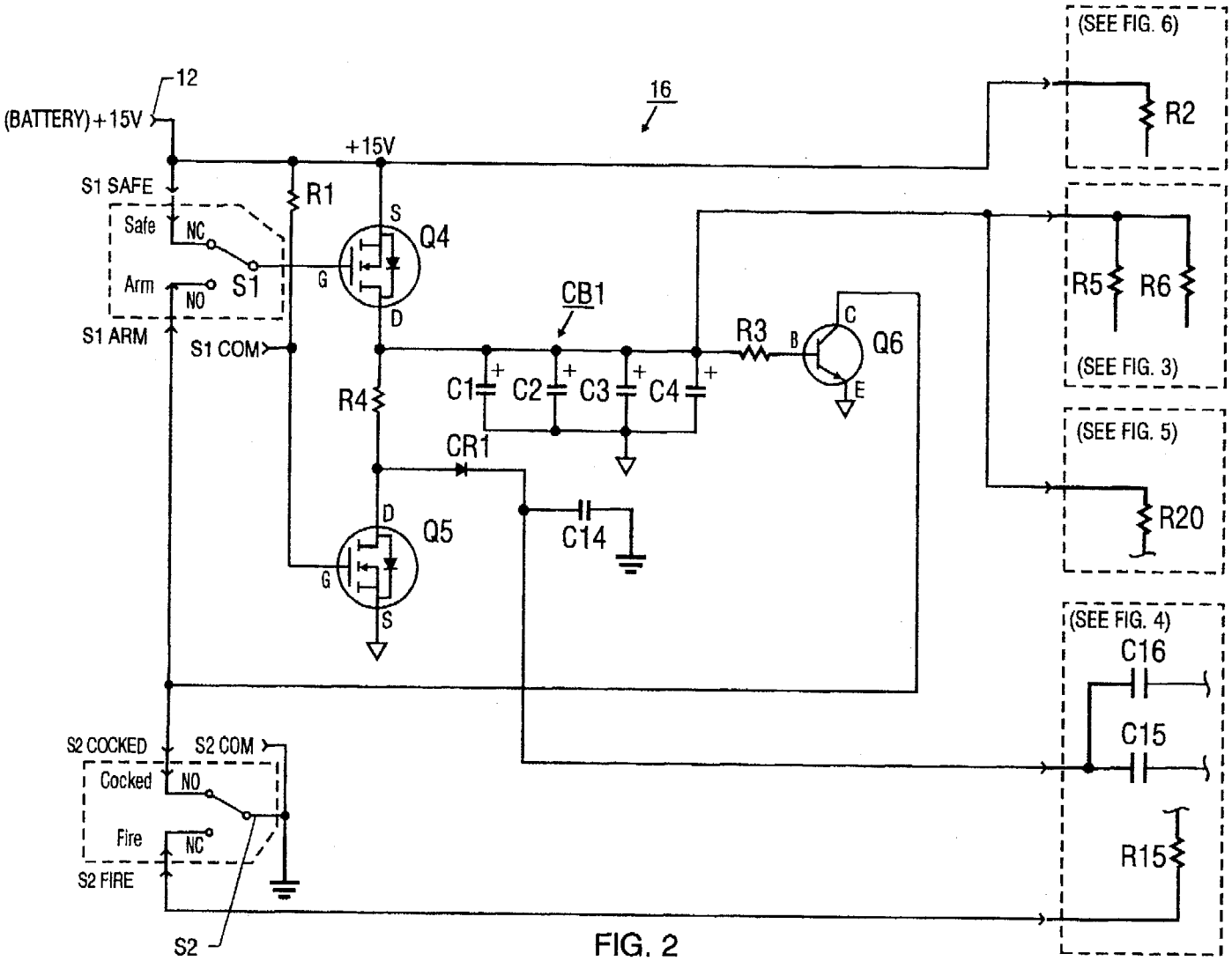
FIG. 2 illustrates the arrangement of the control switches related to the present invention and their responsive circuit elements.

FIG. 2 illustrates the arrangement of the control switches 16 and the first capacitor bank CB1 both generally illustrated in FIG. 1. The control switches 16 preferably comprise first and second manual S1 (SAFE) and S2 (COCKED) and fourth (Q4) and fifth (Q5) electronic switches. The switch S1 has a normally closed contact (NC) indicated as SAFE position thereof, a normally closed (NO) contact indicated as the ARM position thereof, and a movable arm that is switchable between the SAFE and ARM positions, whereas switch S2 has a normally open (NO) contact indicated as the COCKED position thereof, a normally closed (NC) indicated as the FIRE position thereof, and a movable arm that is switchable between the COCKED and FIRE positions. The switchable arm of switch S2 is connected to the ground (same potential as the negative (–) potential of the battery 12). The switchable arm S1 is connected to the battery 12 via the SAFE position. The switchable arm of switch S1 is connected to the gate (control) electrode of both Q4 and Q5, one (Q4) of which, in turn, is connected to the input/output of the first capacitor bank CB1, and the other (Q5) of which is connected the input/output of the first capacitor bank CB1, via R4, and to the source timing 20 and to the sink timing 26 of FIG. 4 both via CR1 and C14.

The first capacitor bank CB1 preferably comprises four capacitors C1, C2, C3 and C4 arranged in parallel as shown in FIG. 2. For the embodiment of FIG. 2, the input and output of the first capacitor bank CB1 are commoned together so that the capacitors C1, C2, C3 and C4 are, as to be described, charged and discharged in parallel. The output of the capacitor bank CB1 is applied to the sixth electronic switch Q6 via R3 and to the dc-dc converter 18 of FIG. 3, and the negative pump circuitry 30 of FIG. 5.

Figure 3:
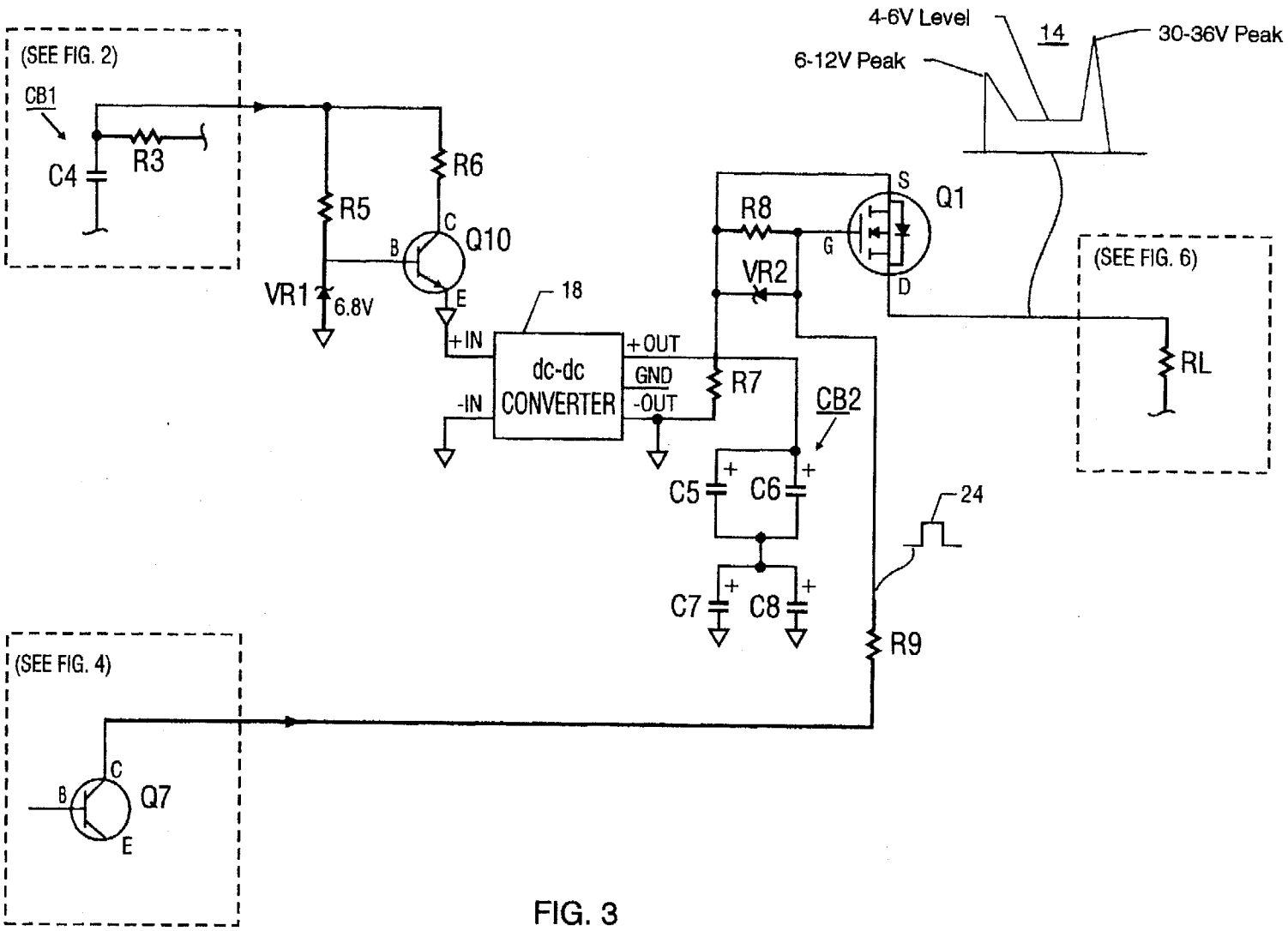
FIG. 3 illustrates a dc-dc converter of the present invention.

As seen in FIG. 3, the output of the first capacitor bank CB1, having a typical value of about 12 volts, is applied to the network comprising R5, R6, VR1 and Q10 (arranged as shown in FIG. 3) which, in turn, is applied to the input of the dc-dc converter 18 but only after the output of the first capacitor bank CB1 reaches the operating voltage of VR1, which is selected to be about 6.8 volts. The dc-dc converter 18 accepts the output from the first capacitor bank CB1 and increases it to a value of about 36 volts at its output stage which, in turn, is applied to the second capacitor bank CB2. The second capacitor bank CB2 comprises capacitors C5, C6, C7, C8 arranged in parallel pairs (C5–C6) and (C7–C8), as shown in FIG. 3, and its output is applied to the first electronic switch Q1 by way of a parallel arrangement of resistor R8 and a zener diode VR2. The voltage (36V) at the output of the second capacitor bank CB2 remains at the first electronic switch Q1 until Q1 is rendered conductive by the application of the second timing signal 24 of FIG. 4.

Figure 4:
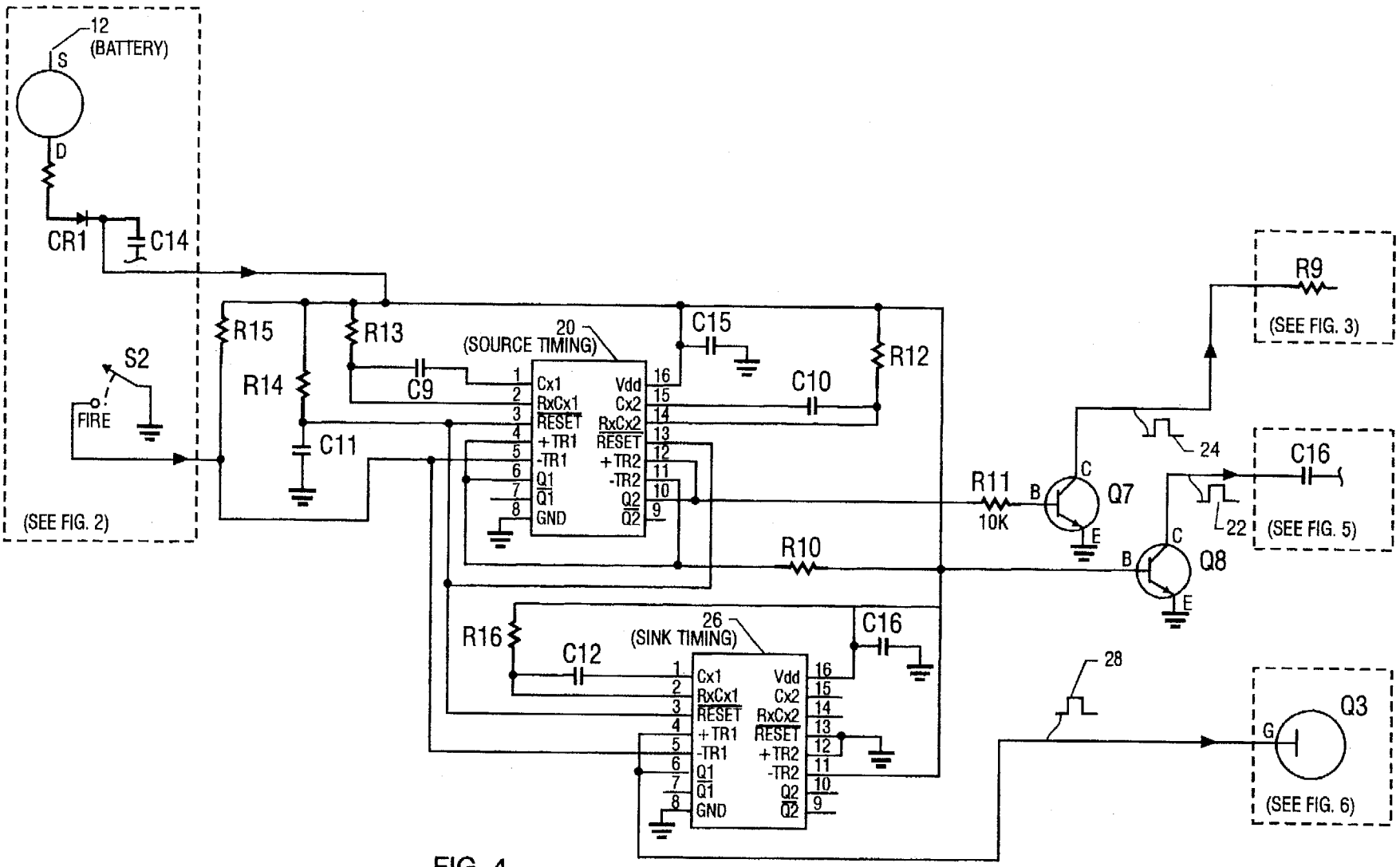
FIG. 4 illustrates the circuit arrangement of the source and sink timing of the present invention.

FIG. 4 illustrates the arrangement of both the source timing 20 and the sink timing 26. In general, the source timing 20 provides first and second timing signals 22 and 24 respectively, each having a predetermined time duration, whereas sink timing 26 provides a third timing signal 28 whose duration is that of the sum of the signals 22 and 24. Both the source timing 20 and the sink timing 26 may be conventional integrated circuits having known input and outputs, with the input and outputs applicable to the present invention to be further described with reference to FIG. 7. The source timing 20 and the sink timing 26 are both connected (via CR1 and C14) to the first capacitor bank CB1 serving as a supplementary or secondary power source and to the primary power source (battery 12), via R4 and electronic switch Q4. Further, both the source timing 20 and the sink timing 26 are connected to the switch S2. The second and first timing signals 24 and 22 are respectively delivered to Q1, via R9 of FIG. 3, and to Q9, via C13 of FIG. 5.

Figure 5:
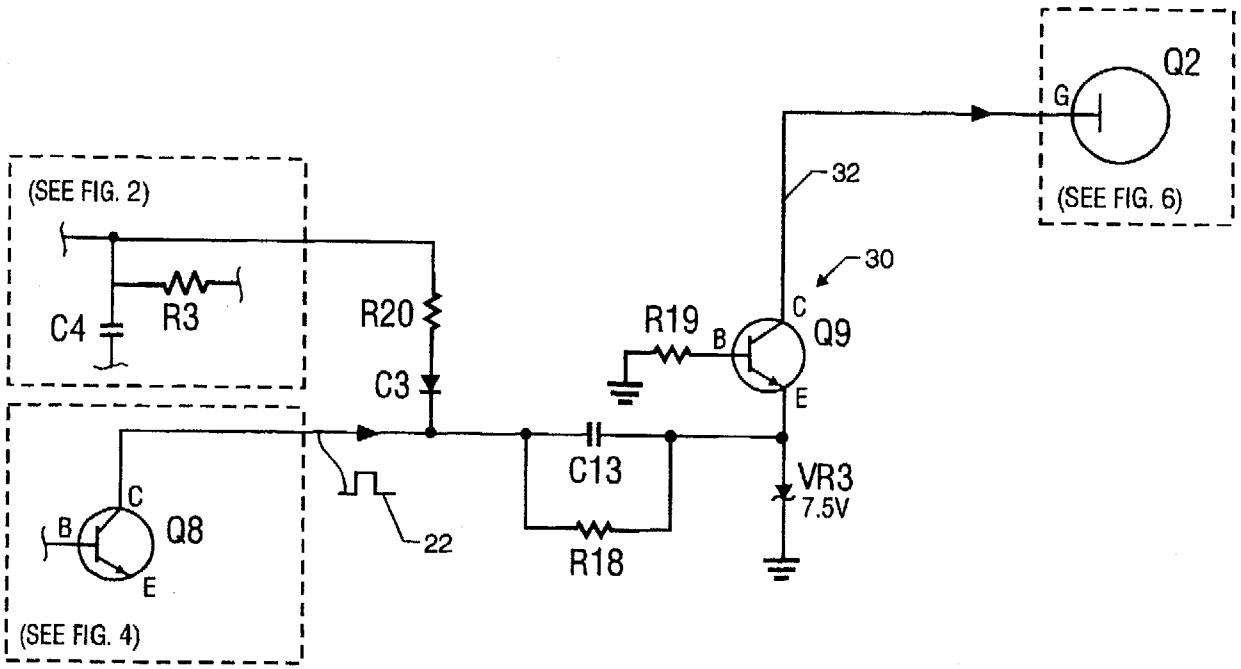
FIG. 5 illustrates the negative pump circuitry of the present invention.

FIG. 5 illustrates the arrangement of the negative pump circuitry 30 which is preferably interposed between the second electronic switch Q2 and the first timing signal 22. If desired, but not recommended, the first timing signal 22 may be applied directly to the gate (control) electrode of Q2 and serve as the bias voltage for the second electronic switch Q2. However, it is preferred that the negative pump circuit 30 be interposed therebetween so that the bias voltage of the second electronic switch Q2 can be increased correspondingly increasing the conduction level of the field effect transistor serving as the second electronic switch Q2 and, thereby, reduce the unwanted associated voltage drop of Q2 which would otherwise be a waste of power involved in the generation and application of the firing pulse 14.

The negative pump circuitry 30 comprises an electronic switch Q9 having its emitter (output) electrode connected to a zener diode VR3 and a parallel arrangement of capacitor C13 and resistor R18 which, in turn, is connected to the serial arrangement of resistor R20 and CR3. The electronic switch Q9, having its collector (input) electrode connected, via control path 32, to the gate (control) electrode of Q2 of FIG. 6, is rendered conductive when the voltage at its emitter, reaches approximately 7.5V, which is the typical operating voltage selected for the zener diode VR3.

Figure 6:
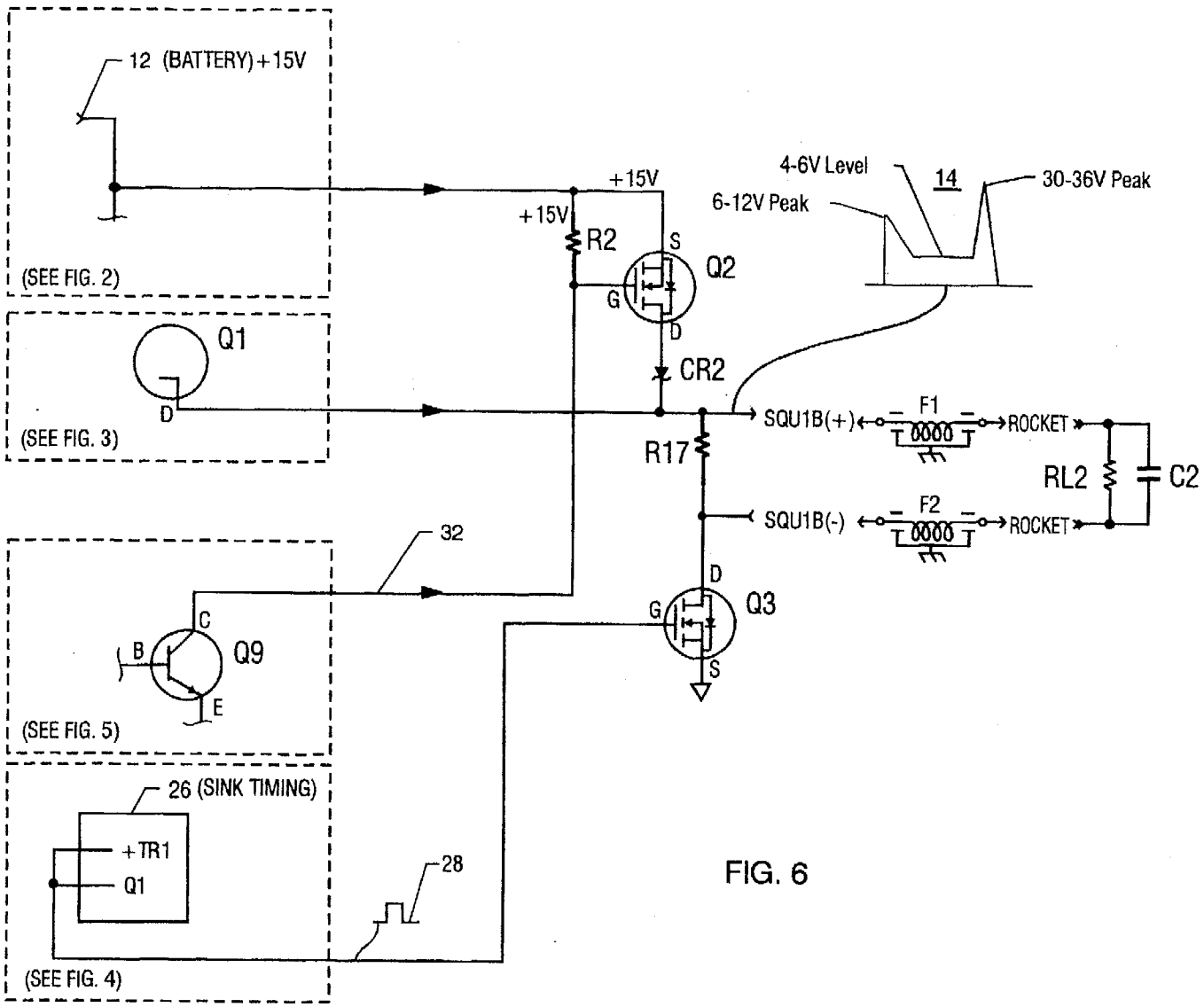
FIG. 6 illustrates the output stage of the firing circuit of the present invention.

FIG. 6 illustrates the output stage of the firing circuit 10 as comprising the second and third electronic switches Q2 and Q3, respectively, arranged in series with the resistor R17. The resistor R17 provides a firing pulse 14 discharge path in the event there is no rocket connected to the launcher and the launcher is fired. The electronic switches Q2 and Q3 cooperatively operate to generate the firing pulse 14 which is applied across resistor RL. The third electronic switch Q3 has its gate (control) electrode connected to the third timing signal 28 generated by the sink timing 26 of FIG. 4.

OPERATION OF THE ELECTRONIC FIRING CIRCUIT

Figure 7:
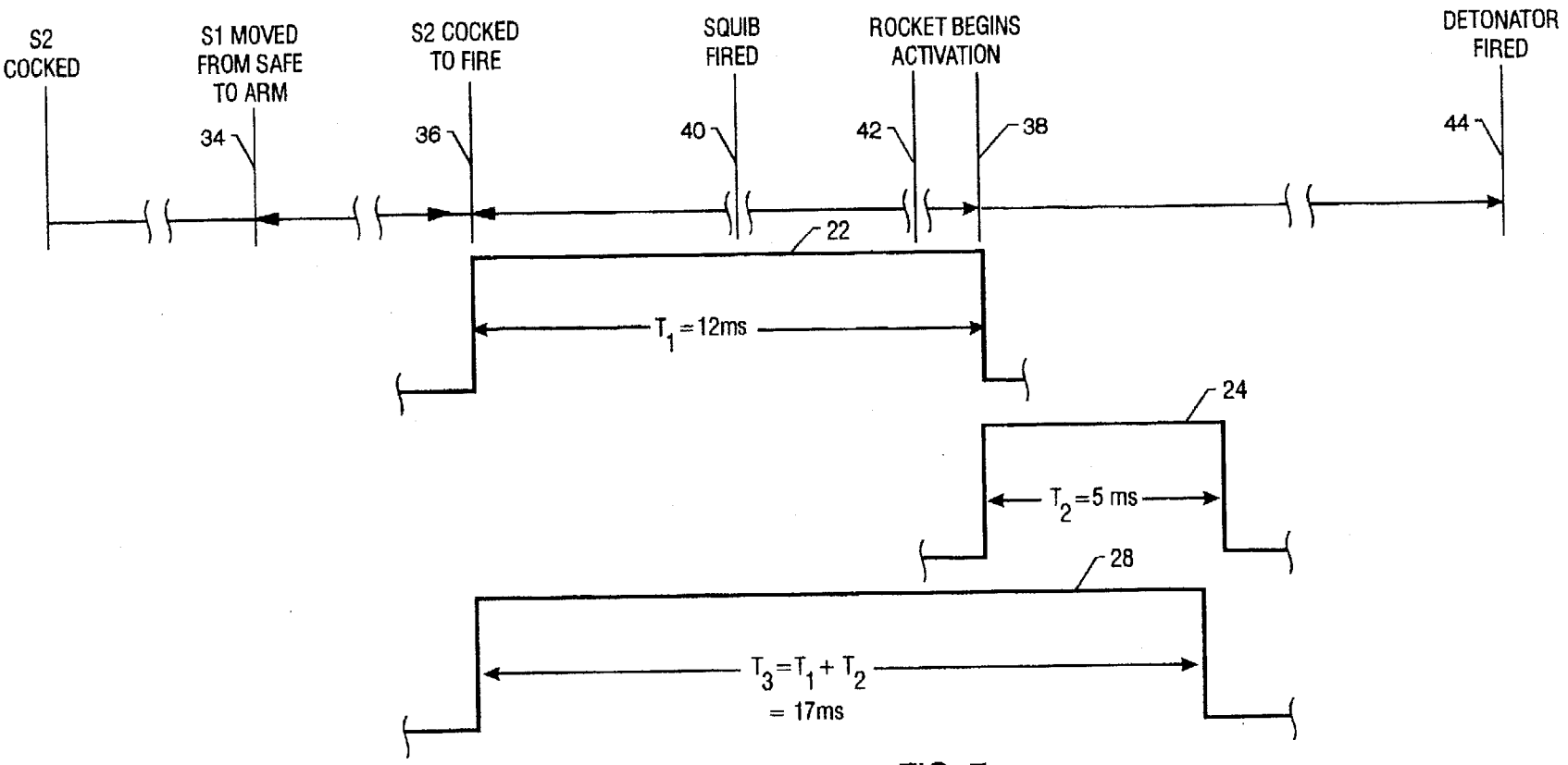
FIG. 7 illustrates a time-event diagram associated with the operation of the present invention.

FIG. 7 shows an events timing diagram generally illustrating the operation of the firing circuit 10 of the present invention. The events illustrated in FIG. 7 are tabulated in Table 2 and the first, second and third timing signals 22, 24, 28 also illustrated in FIG. 7 respectively having typical durations of T1=12 milliseconds, T2=5 milliseconds, and T3=17 milliseconds which is the total accumulative time of T1(12) and T2(5).

TABLE 2

| EVENTS | NOMENCLATURE |
|---|---|
| 34 | Switch S1 moved from Safe to Arm Position |
| 36 | Switch S2 moved from Cocked to Fire Position |
| 38 | T1 duration expires and T2 is initiated |
| 40 | Squib Firing |
| 42 | Rocket Begins Activation |
| 44 | Detonator fired |

With reference to both FIGS. 2 and 7, when the switch S2 is in its COCKED position, the firing circuit 10 is in its dormant condition. However, when the switch S1 is moved from its SAFE to its ARM position (event 34 of FIG. 7), electronic switch Q4 (see FIG. 2) is rendered conductive by having its control (G) electrode connected to the circuit ground via the ARM position of S1 and the COCKED position of S2. When the fourth electronic switch Q4 is conductive, the battery voltage of +15 volts is applied to the first capacitor bank CB1 and also to the dc-dc converter 18 of FIG. 3. Furthermore, the sixth electronic switch Q6 of FIG. 2 maintains the ground potential, via its emitter electrode, on the gate electrodes of Q4 and Q5 when S2 is moved to its FIRE position.

As seen in FIG. 3, the output (approximately 12 volts) from the first bank of capacitors CB1 is accepted by the dc-dc converter 18, via a network comprised of R5, R6, VR1 and Q10, and develops an output voltage (36 volts) that charges the second bank of capacitors CB2. At the same time the dc-dc converter 18 is charging the second bank of capacitors CB2, the output of the first bank of capacitor CB1 (FIG. 2) is also applied to the negative pump circuitry 30 via the path provided by the serially arranged resistor R20 and diode CR3 of FIG. 5. More particularly, the capacitor C13 of the negative pump circuitry 30 is charged via the serial path R20 and CR3.

As seen in FIG. 2, the output of the first capacitor bank CB1 is applied to both the source timing 20 (C15) and the sink timing 6 (C16) via R4, CR1 and the charged capacitor C14. The charge present on C14 is used as an energy trap and serves as a secondary power source for the firing circuit 10 and is applied to the $V_{dd}$ inputs of both the source timing 20 and the sink timing 26 so as to render both operative. It should be noted that not only are the source timing 20 and sink timing 26 powered by the first bank of capacitors CB1, but the source timing 20 and sink timing 26 are also connected to the battery 12 via the conductive fourth electronic switch Q4 (see FIG. 2). The first capacitor bank CB1 is mainly used as a "boost" to the battery 12 during the leading edge portion of the firing pulse 14. The battery voltage typically drops during heavy load (When current is supplied to the rocket motor squib). It should be noted that during such conditions, the squib appears as a one (1) ohm load which is considered to be a relatively heavy load. The combined power (battery 12 and capacitor C14) ensures that any instantaneous drain of current from battery 12 that may occur by the switching of the field effect transistors Q1, Q2 and Q3 in the generator of the firing pulse 14 does not disadvantageously effect the operation of the remaining elements of the firing circuit 10. The firing circuit 10 of FIGS. 2–6 remains in this fully powered, available state until the occurrence of event 36 shown in FIG. 7 and generally indicated in FIG. 4 by the movement of switch S2 to its FIRE position.

As seen in FIG. 4, the placement of switch S2 to its FIRE position causes a ground potential to be applied to the (–TR1) input of the source timing 20. The source timing 20 senses such an occurrence and provides an output Q1 for a selected period, such as 12 millisecond duration shown in FIG. 7 for T1. Also, the presence of Q1 qualifies the eighth electronic switch Q8, thereby, generating the first timing signal 22 which is applied to the capacitor C13 shown in FIG. 5.

As seen in FIG. 5, the conduction of the eighth electronic switch Q8 causes one side of the capacitor C13 to be connected to ground and the other side of the capacitor C13 to be placed at a –7.5V due to the conduction of zener diode VR3 which, in turn, renders the electronic switch Q10 conductive at a –7.5V potential which, in turn, causes the gate (control) electrode of the second electronic switch Q2 to be fully rendered conductive. More particularly, and in a manner as previously described with reference to Q2, the –7.5V causes the field effect transistor Q2 to be biased so that it is fully conductive and reduces any unwanted voltage drop of Q2 that might otherwise waste power. This condition is maintained for the full duration T1 shown in FIG. 7.

As seen in FIG. 7, the event 36 also causes the occurrence of the third timing signal 28 having a duration T3=T1+T2=17 milliseconds and such a generation of timing signal 28 may be further described again with reference to FIG. 4.

As seen in FIG. 4, the placement of the switch S2 to its FIRE position causes a ground potential to be routed to the (–TR1) input of the sink timing 26. In a manner similar to that described in the source timing 20, the sink timing 26 responds to the (–TR1) input by providing a Q1 output which, in turn, generates the timing signal 28 which is applied to the gate (control) electrode of the third electronic switch Q3 rendering it conductive. The firing circuit 10 remains in the condition initiated by event 36, that is, the second and third electronic switches Q2 and Q3 being conductive, until the occurrence of event 38 shown in FIG. 7. At event 38, Q2 is rendered nonconductive, but Q3 remains conductive until the falling edge of timing event T3.

The event 38 of FIG. 7 is caused by the output Q1 of the source timing 20 of FIG. 4 returning to its low condition, more particularly, its trailing edge of the output of Q1 rapidly falling to zero. The rapid falling of the signal present on Q1 is sensed at the (–TR2) input of the source timing 20 which, in turn, causes a signal to be generated at its output Q2 which is applied to Q7, via resistor R11, and the second timing signal 24 is thereby generated having a typical duration T2=5 milliseconds, as shown in FIG. 7. The second timing signal 24 is applied to the first electronic switch Q1 of the dc-dc converter 18 of FIG. 3. During event 22, in particular during timing interval T1, the rocket motor squib is ignited prior to event 38 of FIG. 7. Some 10 to 20 milliseconds after event 38, the rocket motor develops sufficient thrust to begin moving out of the launch tube. The conduction of Q2, which happens prior to the conduction of Q1, last for 12 ms during timing interval T1 of event 22. The conduction of Q2 in conjunction with discharge of capacitor bank CB1, via Q2, is what is necessary to supply sufficient energy to initiate the rocket motor squib of the rocket.

As seen in FIG. 3, the application of the second timing signal 24 causes the conduction of the first electronic switch Q1 which, in turn, causes the output, that is 36V, of the second bank of capacitors CB2 to be applied to the load resistor RL, as well as to the capacitor CL of the rocket, shown in the output stage of FIG. 6. The conduction of the first electronic switch Q1 lasts for the duration (5 milliseconds) of the second timing signal 24 and generates the firing pulse 14 having a sharply rising leading edge. As seen in FIG. 6, the spike pulse 14 that is applied across resistor RL is routed to the capacitor CL via in-line filters F1 and F2. At this point, resistor RL2, the rocket motor squib has been fired, and appears as an open circuit. The spike pulse 14 charges capacitor CL to 22 volts during event 24, in particular during timing interval T2. The rocket motor squib is initiated during timing signal 22, but the rocket motor does not develop sufficient thrust for flight until sometime after timing signal 24 has ended. Once sufficient thrust has been developed by the rocket motor for flight, the rocket flies out of the rocket launcher tube, travels down range, hits a target causing the closure of a crush switch (not shown). The closure of this crush switch places the terminals of the capacitor CL across the leads of a detonator. The capacitor CL delivers sufficient energy to the detonator causing the rocket motor warhead to function.

It should now be appreciated that the practice of the present invention provides for a firing circuit comprised of electronic components. The firing circuit 10 responds to the manual switch commands generated by the switches that control the firing of a rocket from a lightweight launcher.

It should be further appreciated that the practice of the present invention provides for a first capacitor bank that serves as a secondary power source to activate the timing logic to ensure it meets its operational requirements of the launcher in spite of any drain on the battery that may be caused by the generation of the firing pulse. Additionally, and as importantly, this first capacitor bank supplies sufficient energy to initiate the rocket motor squib.

Furthermore, the timing logic has been described as both source and sink timing, and it is desirable that the source and sink timings are handled by separate timing sources as to preclude a single point failure, which could cause inadvertent or unintentional firings.

Obviously, many modifications and variations of the present invention are possible in light of the foregoing teaching. It is, therefore, to be understood that within the scope of the appended claims the invention may be practiced otherwise than as specifically described.

What we claim is:

1. A circuit powered by a battery having positive and negative potentials and serving as a primary power source, said circuit generating a sharp transient firing pulse across positive and negative terminals and comprising:

(a) at least one manual switch switchably connected to said battery and having means for generating first and second commands;

(b) a first bank of capacitors serving as a supplemental power source and having an input and an output with the input switchably connected to and chargeable by said battery by means of said first switch command;

(c) a dc-dc converter connected to said output of said first bank of capacitors and developing an output voltage having a value greater than that of said battery;

(d) a second bank of capacitors having an input and an output with the input connected to the output voltage of said dc-dc converter;

(e) a first source of timing connected to said output of said first bank of capacitors and switchably connected to said battery and responsive to said second command, said first source of timing generating at least first and second timing signals;

(f) a second source of timing connected to said output of said first bank of capacitors and switchably connected to said battery and responsive to said second command, said second source of timing generating a third timing signal;

(g) a first electronic switch having input, output and control electrodes with the input electrode connected to the output of said second capacitor bank, the control electrode being connected to said second timing signal, and the output electrode connected to the positive terminal of said firing circuit;

(h) a second electronic switch having input, output and control electrodes with the input electrode connected to said battery and switchably connected to said output of said first bank of capacitors, the control electrode being connected to said first timing signal, and said output electrode connected to said positive terminal of said firing circuit; and (i) a third electronic switch having input, output and control electrodes with the input electrode connected to the negative terminal of said firing circuit, the control electrode being connected to said third timing signal, and the output electrode connected to the negative potential of said battery.

2. The circuit powered by a battery and generating a sharp transient firing pulse according to claim 1, further comprising means interposed between said control electrode of said second electronic switch and said first timing signal serving as a bias signal thereof, said interposed means increasing the bias level of said second electronic switch so as to correspondingly increase the level of conduction of said second electronic switch.

3. The circuit powered by a battery and generating a sharp transient firing pulse according to claim 2, wherein said first and second timing signals are sequentially generated with each having a predetermined duration and each respectively applied to said means for increasing the bias level of said second electronic switch and said control electrode of said first electronic switch by seventh and eighth electronic switches.

4. The circuit powered by a battery and generating a sharp transient firing pulse according to claim 2, wherein said means for increasing the bias level of said second electronic switch comprises a ninth electronic switch having input, output and control electrodes with the output electrode connected to the negative terminal of said firing circuit by means of a zener diode having a preselected voltage drop.

5. The circuit powered by a battery and generating a sharp transient firing pulse according to claim 1, wherein said at least one manual switch comprises first and second manual switches and said means for generating said first and second commands comprises:

(a) said first manual switch having a switch arm switchably connectable to said battery so as to switchably render conductive fourth and fifth electronic switches one of which switch connects said output of said first bank of capacitors to first and second sources of timing and the other which connects said input of said first bank of capacitors to said battery; and (b) said second manual switch having a switch arm switchably connectable to said output of said first capacitor bank by a sixth electronic switch that is rendered conductive by the presence of said battery positive potential at said input of said first bank of capacitors, said second manual switch generating said second command.

6. The circuit powered by a battery and generating a sharp transient firing pulse according to claim 5, wherein said first capacitor bank comprises a plurality of capacitors arranged in parallel with a first end thereof serving as both the input and output of said first bank and a second end connected to said negative terminal of said firing circuit, said first end of said first capacitor bank further comprising a unilateral device and a capacitor arranged in series and with said first and second sources being connected to the node therebetween.

7. The circuit powered by a battery and generating a sharp transient firing pulse according to claim 1, wherein said second capacitor bank comprises a plurality of capacitors arranged in parallel pairs with a first end thereof serving as both the input and output of said second bank and a second end connected to said negative terminal of said firing circuit, said first end connected to said control electrode of said first electronic switch by means of a parallel arrangement comprising a resistor and a zener diode.

8. The circuit powered by a battery and generating a sharp transient firing pulse according to claim 1, wherein said first, second and third electronic switches are field effect transistors.

* * * * *